US008681049B2

(12) United States Patent
Su et al.

(10) Patent No.: US 8,681,049 B2
(45) Date of Patent: Mar. 25, 2014

(54) BUILT-IN FM TRANSMITTING ANTENNA APPLIED TO A MOBILE DEVICE

(75) Inventors: Saou-Wen Su, Keelung (TW); Chao-Hsu Chen, Sijhih (TW); Kuo-Wei Yang, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 647 days.

(21) Appl. No.: 12/730,464

(22) Filed: Mar. 24, 2010

(65) Prior Publication Data

US 2011/0175774 A1 Jul. 21, 2011

(30) Foreign Application Priority Data

Jan. 19, 2010 (CN) ..... 2010 1 0004092

(51) Int. Cl.
*H01Q 5/00* (2006.01)

(52) U.S. Cl.
USPC ..... 343/700 MS; 455/575

(58) Field of Classification Search
USPC ..... 343/702; 455/575
See application file for complete search history.

(56) References Cited

U.S. PATENT DOCUMENTS 7,856,259 B2 * 12/2010 Bergh ..... 455/575.5
8,024,014 B2 * 9/2011 Boyle ..... 455/575.1
8,537,072 B2 * 9/2013 Jensen et al. ..... 343/873
2006/0111163 A1 5/2006 Oh
2008/0117120 A1 * 5/2008 Su et al. ..... 343/895

FOREIGN PATENT DOCUMENTS

TW M283445 12/2005
TW 200620752 6/2006

* cited by examiner

*Primary Examiner* — Hoang V Nguyen
*Assistant Examiner* — Kyana R Robinson
(74) *Attorney, Agent, or Firm* — Li&Cai Intellectual Property (USA) Office

(57) ABSTRACT

A built-in FM transmitting antenna applied to a mobile device, includes a substrate unit, a first antenna unit, a conducting unit and a second antenna unit. The substrate unit has a circuit substrate, at least one grounding layer disposed on the circuit substrate, and a plurality of conducting pads disposed on the circuit substrate. The first antenna unit is disposed above the substrate unit and substantially parallel to the substrate unit. The conducting unit is electrically connected between the substrate unit and the first antenna unit. The second antenna unit is directly disposed on the edge of the top surface of the circuit substrate. The second antenna unit has two ends electrically connected between two of the conducting pads, respectively. The two ends of the second antenna unit are electrically connected to an FM chip module and the conducting unit through the two of the conducting pads, respectively.

10 Claims, 6 Drawing Sheets

BUILT-IN FM TRANSMITTING ANTENNA APPLIED TO A MOBILE DEVICE

BACKGROUND OF THE INVENTION

1. Field of the Invention

The present invention relates to a FM (Frequency Modulation) transmitting antenna and in particular, to a built-in FM transmitting antenna applied to a mobile device.

2. Description of Related Art

Frequency modulation broadcasting system (FM system) is a broadcasting system utilizing a frequency modulation technique to transmit audio signals. Compared with amplitude modulation (AM) broadcasting system, the FM system has advantages of constant envelope, capabilities of anti-nonlinear-distortion and anti-fading-effect, etc. Thus, the FM system has better signal quality and is capable of transmitting stereo signals, which includes left and right channel signals.

A receiver (ex. radio) of the FM system receives FM signals through an antenna, and outputs audio signals after frequency-down-conversion, demodulation, and related operations. Therefore, the main factor of audio quality outputted by the radio depends on reception efficiency of the antenna. In the related art, the majority of FM antennas are external antennas, and rod monopole antennas and dipole antennas covered with PolyEthylen (PE) are representatives.

Please refer to FIG. 1 and FIG. 2, which are schematic diagrams of a rod monopole antenna 1*a* and a PE dipole antenna 2*a*. The rod monopole antenna 1*a* is commonly fixed on a corner of a housing of a portable stereo or a handy radio. When a user wants to listen to broadcasting programs, the user needs to draw out the rod monopole antenna 1*a* to a specific length. When the rod monopole antenna 1*a* is not used, the user may deposit the rod monopole antenna 1*a* in order to save space. Since the rod monopole antenna 1*a* needs to be drawn out to a certain length about 76 cm in use condition, the rod monopole antenna 1*a* is easily broken, space wasting, and deficient in esthetic appearance. On the contrary, the PE dipole antenna 2*a* is commonly applied to mounted stereo facilities, and may prevent from being broken. However, the price of the PE dipole antenna 2*a* is high, about US$1, and a long parallel transmission line 20*a* connecting radiating metal wires 22*a*, 24*a* of the PE dipole antenna 2*a* with an antenna plug set on the stereo facility is needed, which makes the PE dipole antenna 2*a* to be entwisted and knot.

In brevity, the rod monopole antenna 1*a* has a larger size and exposes on a housing of a portable or handy radio, so that the rod monopole antenna 1*a* is easily broken by external force, wastes space and lacks esthetic appearance. The PE dipole antenna 2*a* costs higher price, and is easily entwisted and knots. Architecture of these antennas not only makes users more inconvenient in use but also lacks esthetic appearance. In order to improve the above-mentioned problems of exposure antennas, it is necessary to design a hidden antenna with impedance and bandwidth suitable for requirements of the FM system.

TW patent No. M283445 discloses a mobile phone with FM antenna including a minimized hidden antenna, which is assembled on two sides and the bottom of the mobile phone. In such architecture, the antenna is often too close to the ground plane so that the antenna commonly has great capacitance and inductance Impedance matching of the antenna becomes worse, effecting signal quality of the FM antenna.

In addition, TW patent No. 200620752 discloses an antenna for mobile terminal and mobile terminal including an antenna composed of various units. The antenna has an antenna element installed on a housing and a metal coil hidden inside the housing. Such architecture often combines metal coils of the antenna with those inside the housing of the mobile phone, which increases the complexity and production cost of the antenna.

Besides, US publication patent No. 2006/0111163A1 disclose an FM transmission antenna device in a portable terminal. The FM transmission antenna device includes an antenna pattern attached to a surface of the portable terminal, an FPC extended from the antenna pattern, and a connector provided at an end of the FPC, for connecting the FPC to an FM transmitter. However, the antenna structure is complex, antenna area is small, and radiation property is bad.

SUMMARY OF THE INVENTION

In view of the aforementioned issues, the present invention provides a built-in FM transmitting antenna applied to a mobile device.

To achieve the above-mentioned objectives, the present invention provides a built-in FM transmitting antenna applied to a mobile device, including: a substrate unit, a first antenna unit, a conducting unit and a second antenna unit. The substrate unit has a circuit substrate, at least one grounding layer disposed on the circuit substrate, and a plurality of conducting pads disposed on the circuit substrate. The first antenna unit is disposed above the substrate unit and substantially parallel to the substrate unit. The conducting unit is electrically connected between the substrate unit and the first antenna unit. The second antenna unit is directly disposed on an edge of a top surface of the circuit substrate of the substrate unit. The second antenna unit has two ends respectively electrically connected to two of the conducting pads, and the two ends of the second antenna unit are respectively electrically connected to an FM chip module and the conducting unit through the two of the conducting pads.

To achieve the above-mentioned objectives, the present invention provides a built-in FM transmitting antenna applied to a mobile device, including: including: a substrate unit, a first antenna unit, a conducting unit and a second antenna unit. The substrate unit has a circuit substrate installed in the mobile device, at least one grounding layer disposed on the circuit substrate, and a plurality of conducting pads disposed on the circuit substrate. The first antenna unit is disposed above the substrate unit and attached to or formed on an inner surface of a casing of the mobile device. The first antenna unit is substantially parallel to the substrate unit. The conducting unit is electrically connected between the substrate unit and the first antenna unit. The second antenna unit is directly disposed on an edge of a top surface of the circuit substrate of the substrate unit. The second antenna unit has two ends respectively electrically connected to two of the conducting pads, and the two ends of the second antenna unit are respectively electrically connected to an FM chip module and the conducting unit through the two of the conducting pads.

Therefore, the at least one grounding layer of the substrate unit, the first antenna unit and the second antenna unit cooperate with each other to form an equivalent circuit as a resonator. In other words, the built-in FM transmitting antenna is a composite antenna design that includes a second antenna unit to generate inductive characteristics and a first antenna unit as a patch capacitor almost levelly disposed above the substrate unit (such as a system PCB with grounding layer) to generate capacitive characteristics, so that the built-in FM transmitting antenna may provide an equivalent circuit as an RCL resonator.

In order to further understand the techniques, means and effects the present invention takes for achieving the prescribed objectives, the following detailed descriptions and appended drawings are hereby referred, such that, through which, the purposes, features and aspects of the present invention may be thoroughly and concretely appreciated; however, the appended drawings are provided solely for reference and illustration, without any intention that they be used for limiting the present invention.

DETAILED DESCRIPTION OF THE PREFERRED EMBODIMENTS

Figure 1:
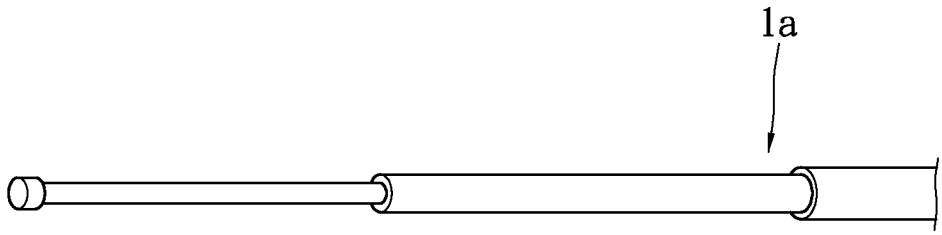
FIG. 1 PRIOR ART
FIG. 1 is a schematic diagram of the rod monopole antenna according to the related art.
Figure 2:
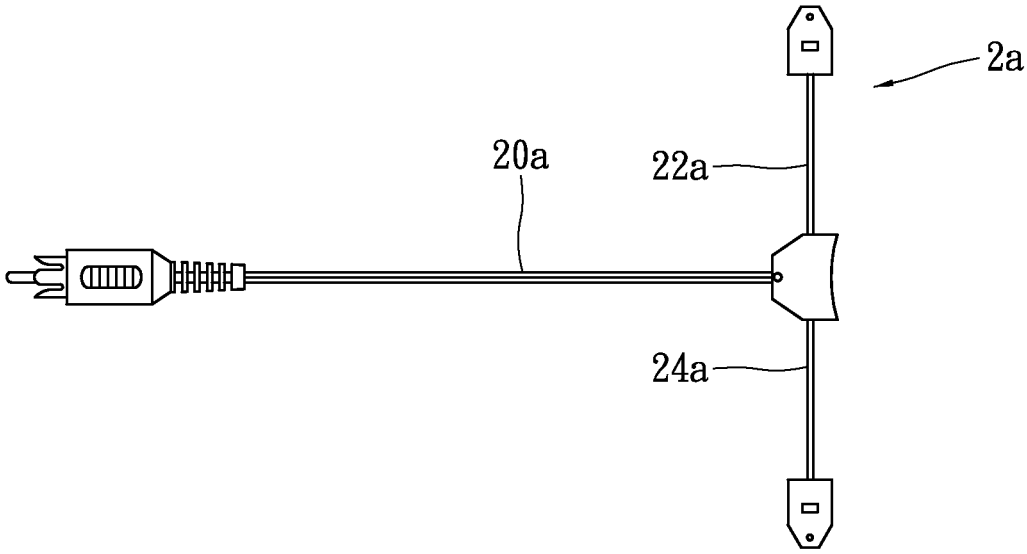
FIG. 2 PRIOR ART
FIG. 2 is a schematic diagram of the PolyEthylen (PE) dipole antenna according to the related art.
Figure 3:
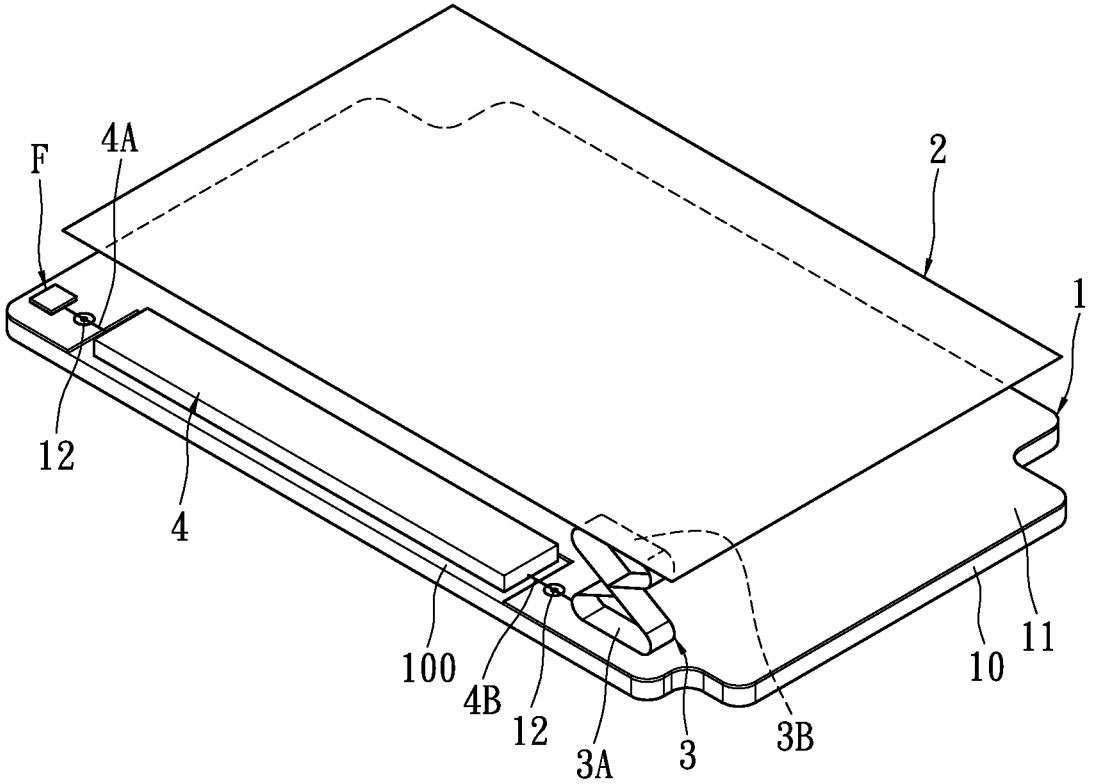
FIG. 3 is a perspective, assembled, schematic view of the built-in FM transmitting antenna applied to the mobile device according to the first embodiment of the present invention.

FIG. 3 shows a perspective, assembled, schematic view of the built-in FM transmitting antenna applied to the mobile device according to the first embodiment of the present invention. The first embodiment provides a built-in FM transmitting antenna applied to a mobile device, including a substrate unit 1, a first antenna unit 2, a conducting unit 3 and a second antenna unit 4.

The substrate unit 1 has a circuit substrate 10, at least one grounding layer 11 disposed on the circuit substrate 10, and a plurality of conducting pads 12 disposed on the circuit substrate 10. For example, the at least one grounding layer 11 and the conducting pads 12 are disposed on the top surface of the circuit substrate 10, and the at least one grounding layer 11 does not cover the conducting pads 12. The circuit substrate 10 has a no-ground region 100 formed on the top surface thereof, and the no-ground region 100 does not be covered by the at least one grounding layer 11.

Moreover, the first antenna unit 2 is disposed above the substrate unit 1 and substantially parallel to the substrate unit 1. The first antenna unit 2 and the substrate unit 1 are parallel to each other and the area of the first antenna unit 2 is larger than that of the substrate unit 1 in the best embodiment. For example, the first antenna unit 2 may be a metal plate, a patch, a metal film or any conducting substance that is disposed above the substrate unit 1 and substantially parallel to the substrate unit 1.

Furthermore, the conducting unit 3 has a first end 3A and a second end 3B opposite to the first end 3A, and the first end 3A and the second end 3B are respectively connected to the substrate unit 1 and the first antenna unit 2. Hence, the conducting unit 3 is electrically connected between the substrate unit 1 and the first antenna unit 2, and the present invention may take the conducting unit 3 as an electrical bridge between the substrate unit 1 and the first antenna unit 2. For example, the conducting unit 3 may be a flexible element such as spring, elastic piece or any elastic substance. In other words, the present invention may use a single-piece flexible element or an integrally-formed flexible element to achieve the electrical connection between the substrate unit 1 and the first antenna unit 2 without designing any other complex structure between the substrate unit 1 and the first antenna unit 2.

In addition, the second antenna unit 4 is directly disposed on an edge of a top surface of the circuit substrate 10 of the substrate unit 1. In other words, the second antenna unit 4 is not disposed on the at least one grounding layer 11 and is disposed on the no-ground region 100 of the circuit substrate 10. The second antenna unit 4 may be disposed between the substrate unit 1 and the first antenna unit 2. Of course, one part of the first antenna unit 2 above the second antenna unit 4 may be removed, so that the second antenna unit 4 is not shaded by the first antenna unit 2. Besides, the second antenna unit 4 has two ends (4A, 4B) respectively electrically connected to two of the conducting pads 12, and the two ends (4A, 4B) of the second antenna unit 4 are respectively electrically connected to an FM chip module F and the conducting unit 3 through the two of the conducting pads 12. The antenna operating frequency of the present invention may be decreased by using the second antenna unit 4, so that the built-in FM transmitting antenna can resonate in the FM band.

Hence, the at least one grounding layer 11 of the substrate unit 1, the first antenna unit 2 and the second antenna unit 4 cooperate with each other to form an equivalent circuit as a resonator. In other words, the built-in FM transmitting antenna is a composite antenna design that includes a second antenna unit 4 to generate inductive characteristics and a first antenna unit 2 as a patch capacitor almost levelly disposed above the substrate unit 1 (such as a system PCB with grounding layer 11) to generate capacitive characteristics, so that the built-in FM transmitting antenna may provide an equivalent circuit as an RCL resonator. In addition, the resonant frequency of the RLC resonator is $w_0=1/\sqrt{LC}$, so that the inductance value generated by the second antenna unit 4 and the capacitance value generated by the first antenna unit 2 (the capacitance value is to be varied according to the area value of the first antenna unit 2) may be adjusted according to different combinations.

Figure 4A:
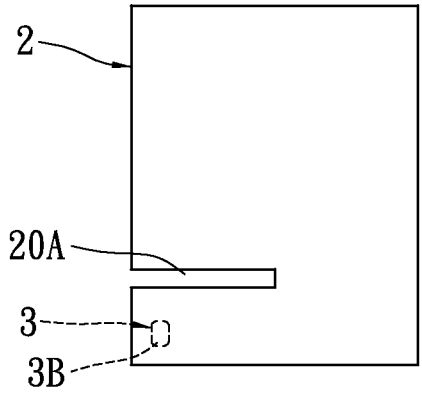
FIG. 4A is a top, schematic view of the first antenna unit cooperating with the conducting unit according to the second embodiment of the present invention.

FIG. 4A shows a top, schematic view of the first antenna unit cooperating with the conducting unit according to the second embodiment of the present invention. Referring to FIGS. 3 and 4A, the difference between the second embodiment and the first embodiment is that: in the second embodiment, the first antenna unit 2 has a slit 20A adjacent to the second end 3B of the conducting unit 3. Hence, the inductance value of the built-in FM transmitting antenna may be increased due to the design of the slit 20A.

Figure 4B:
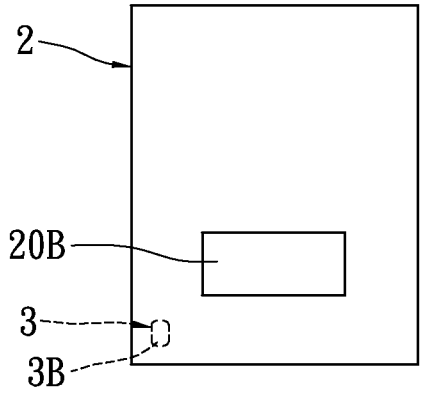
FIG. 4B is a top, schematic view of the first antenna unit cooperating with the conducting unit according to the third embodiment of the present invention.

FIG. 4B shows a top, schematic view of the first antenna unit cooperating with the conducting unit according to the third embodiment of the present invention. Referring to FIGS. 3 and 4B, the difference between the third embodiment and the first embodiment is that: in the third embodiment, the first antenna unit 2 has a slot 20B adjacent to the second end 3B of the conducting unit 3. Hence, the capacitance value of the built-in FM transmitting antenna may be increased due to the design of the slot 20B.

Figure 5A:
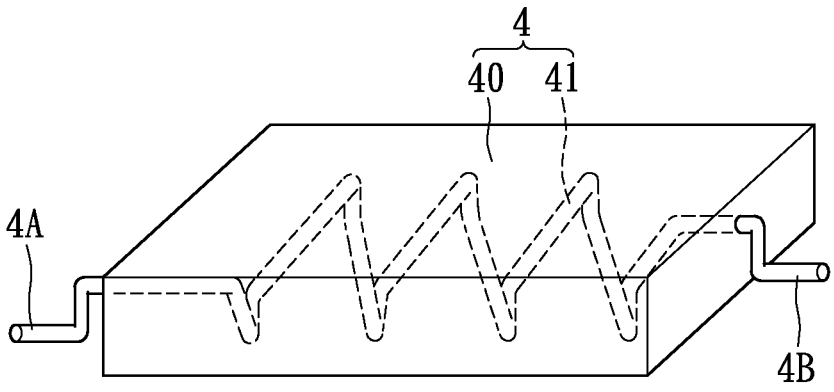
FIG. 5A is a perspective, schematic view of the second antenna unit according to the fourth embodiment of the present invention.

FIG. 5A shows a perspective, schematic view of the second antenna unit 4 according to the fourth embodiment of the present invention. Referring to FIGS. 3 and 5A, the difference between the fourth embodiment and the first embodiment is that: the fourth embodiment discloses a first-type structure for the second antenna unit 4. The second antenna unit 4 may be a chip antenna that has an insulative substance 40 and a metal wire 41 embedded into the insulative substance 40. The metal wire 41 has two ends (4A, 4B) exposed outside the insulative substance 40, and the two ends (4A, 4B) may be two electrical extensions to connect with other electronic components. In addition, the metal wire 41 has a three-dimensional helical structure such as a 3D spring.

Figure 5B:
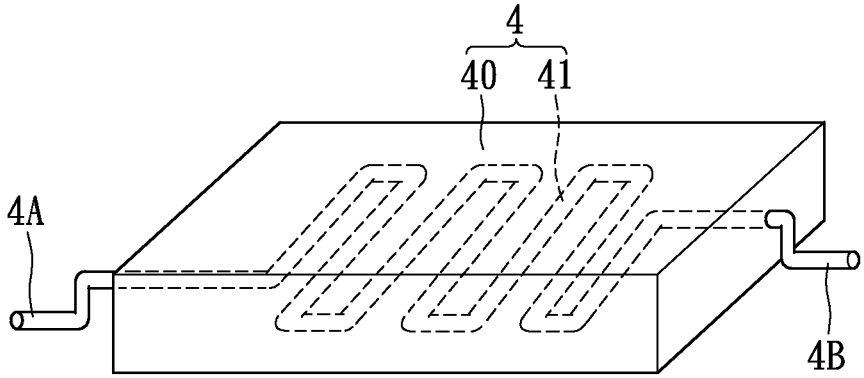
FIG. 5B is a perspective, schematic view of the second antenna unit according to the fifth embodiment of the present invention.

FIG. 5B shows a perspective, schematic view of the second antenna unit 4 according to the fifth embodiment of the present invention. Referring to FIGS. 3 and 5B, the difference between the fifth embodiment and the first embodiment is that: the fifth embodiment discloses a second-type structure for the second antenna unit 4. The second antenna unit 4 may be a chip antenna that has an insulative substance 40 and a metal wire 41 embedded into the insulative substance 40. The metal wire 41 has two ends (4A, 4B) exposed outside the insulative substance 40, and the two ends (4A, 4B) may be two electrical extensions to connect with other electronic components. In addition, the metal wire 41 may be meandered on the same plane to form a meandering shape.

Figure 5C:
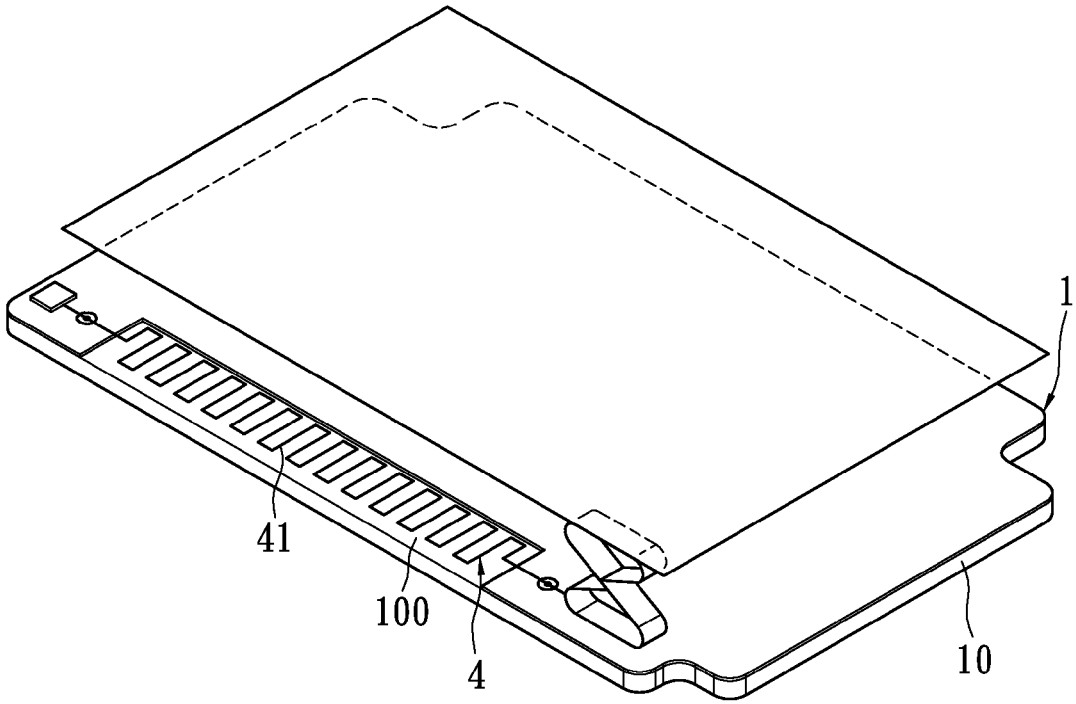
FIG. 5C is a perspective, schematic view of the second antenna unit directly disposed on an edge of a top surface of the circuit substrate of the substrate unit according to the sixth embodiment of the present invention.

FIG. 5C shows a perspective, schematic view of the second antenna unit 4 directly disposed on an edge of a top surface of the circuit substrate of the substrate unit according to the sixth embodiment of the present invention. Referring to FIGS. 3 and 5C, the difference between the sixth embodiment and the first embodiment is that: the sixth embodiment discloses a third-type structure for the second antenna unit 4. The second antenna unit 4 may be a meandering metal line 41 directly disposed on the edge of the top surface of the circuit substrate 10 of the substrate unit 1. In other words, meandering metal line 41 is directly formed on the no-ground region 100 of the circuit substrate 10. For example, the meandering metal line 41 may be formed on the no-ground region 100 of the circuit substrate 10 by printing, etching or spraying etc.

Figure 6:
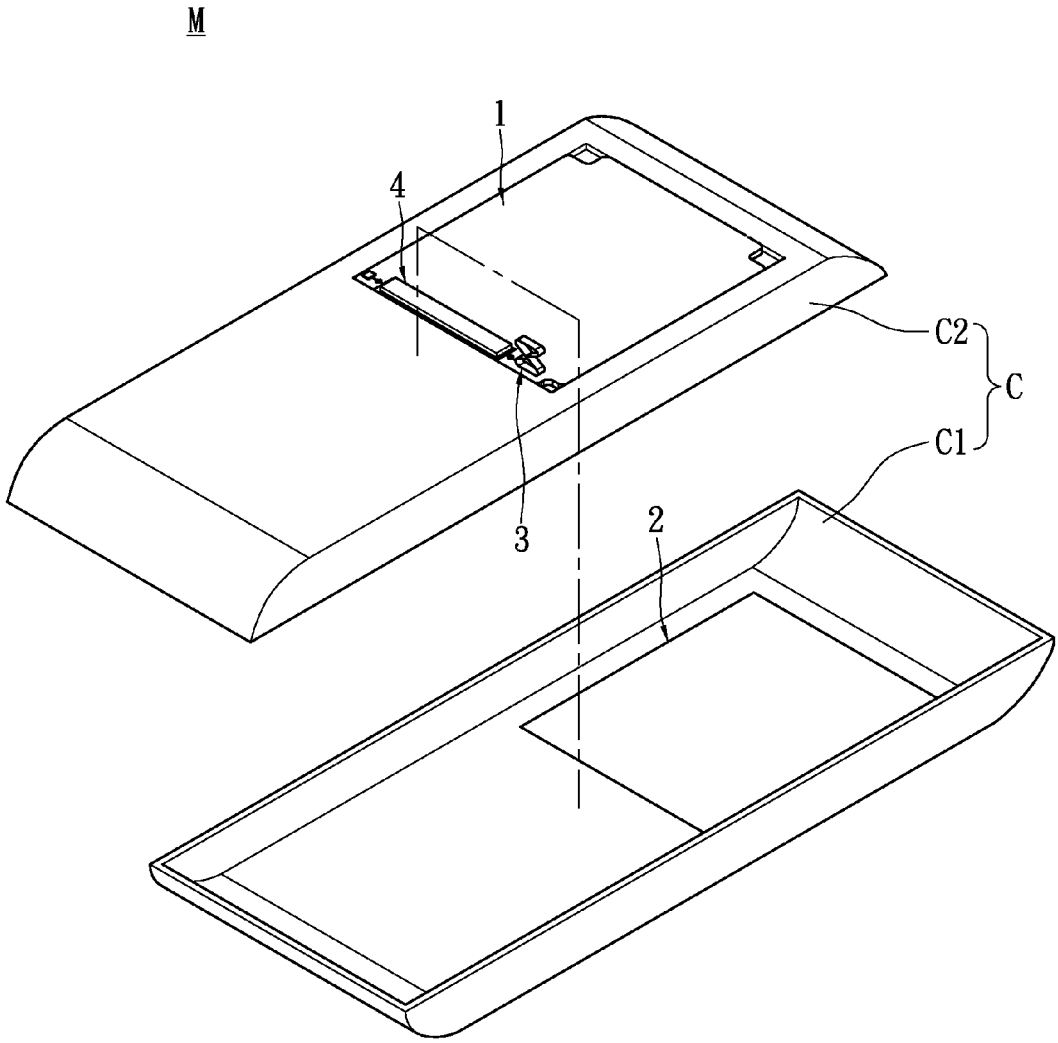
FIG. 6 is a perspective, exploded, schematic view of the built-in FM transmitting antenna of the first embodiment applied to the mobile device.

FIG. 6 shows a perspective, exploded, schematic view of the built-in FM transmitting antenna of the first embodiment applied to the mobile device. The difference between FIG. 6 and FIG. 3 is that: FIG. 6 discloses a mobile device M and a casing C of the mobile device M. The casing C may be composed of a top cover C1 and a bottom cover C2, and the built-in FM transmitting antenna of the first embodiment is installed in the mobile device M.

For example, the substrate unit 1 and the second antenna unit 4 are installed in the bottom cover C2, and the first antenna unit 2 is disposed above the substrate unit 1 and disposed on an inner surface of the top cover C1 of the mobile device M. In addition, the first antenna unit 2 may be a metal plate or metal film (such as conducting copper foil) attached to the inner surface of the top cover C1 of the mobile device M. Of courser, the first antenna unit 2 may be a metal layer formed on the inner surface of the top cover C1 of the mobile device M by printing or spraying. Hence, the present invention has some advantages such as simple structure, easy to manufacture and low manufacturing cost etc.

In other words, the area of the first antenna unit 2 may be selectively increased, and the first antenna unit 2 may be fixed or formed on the inner surface of the top cover C1 of the casing C of the mobile device M. The area of the first antenna unit 2 may be similar to that of the substrate unit 1 (the system PCB) or the top cover C1, so that the present invention is different from the FM antenna of the prior art. When the area of the first antenna unit 2 is increased, the effective radiating area of the present invention is substantially increased. In addition, because the present invention has a large effective radiating area and good radiation properties, the present invention is suitably applied to the mobile device M. Because the built-in FM transmitting antenna is built into the mobile device M, the present invention may enhance the appearance of the product (such as the mobile device M) that uses the built-in FM transmitting antenna.

The above-mentioned descriptions merely represent solely the preferred embodiments of the present invention, without any intention or ability to limit the scope of the present invention which is fully described only within the following claims. Various equivalent changes, alterations or modifications based on the claims of present invention are all, consequently, viewed as being embraced by the scope of the present invention.

What is claimed is:

1. A built-in FM transmitting antenna applied to a mobile device, comprising:

a substrate unit having a circuit substrate, at least one grounding layer disposed on the circuit substrate, a plurality of conducting pads disposed on the circuit substrate, and a no-ground region disposed on the circuit substrate, wherein the at least one grounding layer does not cover the plurality of the conducting pads and the no-ground region;

a first antenna unit disposed above the substrate unit and substantially parallel to the substrate unit;

a conducting unit electrically connected between the substrate unit and the first antenna unit; and a second antenna unit directly disposed on the no-ground region, for decreasing an antenna operating frequency, wherein the second antenna unit has two ends respectively electrically connected to two of the conducting pads, and the two ends of the second antenna unit are respectively electrically connected to an FM chip module and the conducting unit through the two of the conducting pads.

2. The built-in FM transmitting antenna as claimed in claim 1, wherein the conducting unit is a flexible element.

3. The built-in FM transmitting antenna as claimed in claim 1, wherein the first antenna unit is a metal plate or a metal film.

4. The built-in FM transmitting antenna as claimed in claim 1, wherein the first antenna unit has a slit or a slot adjacent to the conducting unit.

5. The built-in FM transmitting antenna as claimed in claim 1, wherein the second antenna unit is a chip antenna that has an insulative substance and a metal wire embedded into the insulative substance, the metal wire has two ends exposed outside the insulative substance, and the metal wire has a three-dimensional helical structure.

6. The built-in FM transmitting antenna as claimed in claim 1, wherein the second antenna unit is a chip antenna that has an insulative substance and a metal wire embedded into the insulative substance, the metal wire has two ends exposed outside the insulative substance, and the metal wire is meandered on a plane.

7. The built-in FM transmitting antenna as claimed in claim 1, wherein the second antenna unit is a metal line directly disposed on the edge of the top surface of the circuit substrate of the substrate unit.

8. The built-in FM transmitting antenna as claimed in claim 1, wherein the at least one grounding layer, the first antenna unit and the second antenna unit cooperate with each other to form an equivalent circuit as a resonator.

9. A built-in FM transmitting antenna applied to a mobile device, comprising:

a substrate unit having a circuit substrate installed in the mobile device, at least one grounding layer disposed on the circuit substrate, a plurality of conducting pads disposed on the circuit substrate, and a no-ground region disposed on the circuit substrate, wherein the at least one grounding layer does not cover the plurality of the conducting pads and the no-ground region;

a first antenna unit disposed above the substrate unit and attached to or formed on an inner surface of a casing of the mobile device, wherein the first antenna unit is substantially parallel to the substrate unit;

a conducting unit electrically connected between the substrate unit and the first antenna unit; and a second antenna unit directly disposed on the no-ground region, for decreasing an antenna frequency, wherein the second antenna unit has two ends respectively electrically connected to two of the conducting pads, and the two ends of the second antenna unit are respectively electrically connected to an FM chip module and the conducting unit through the two of the conducting pads.

10. The built-in FM transmitting antenna as claimed in claim 9, wherein the at least one grounding layer, the first antenna unit and the second antenna unit cooperate with each other to form an equivalent circuit as a resonator.

* * * * *